United States Patent [19]

Banks et al.

[11] 3,970,091

[45] July 20, 1976

[54] CRYOGENIC THRESHING OF TOBACCO

[75] Inventors: Jon F. Banks; Eugene F. Livesay, both of Louisville, Ky.; Reynold W. Martin, Union Beach, N.J.

[73] Assignee: Brown & Williamson Tobacco Corporation, Louisville, Ky.

[22] Filed: Feb. 6, 1975

[21] Appl. No.: 547,458

[52] U.S. Cl. ..... 131/122

[51] Int. Cl.[2] ..... A24B 5/06

[58] Field of Search..... 131/17, 120, 140, 122–132, 131/145, 146; 146/55, 237, 238, 226

[56] References Cited

UNITED STATES PATENTS

| | | | |
|---|---|---|---|
| 2,344,106 | 3/1944 | Reed | 131/136 |
| 2,661,746 | 12/1953 | Schoenbaum et al. | 131/127 X |
| 3,507,310 | 4/1970 | Forkner | 146/226 |
| 3,837,481 | 9/1974 | Stungis et al. | 131/140 P |

*Primary Examiner*—Robert W. Michell
*Assistant Examiner*—V. Millin
*Attorney, Agent, or Firm*—Finnegan, Henderson, Farabow & Garrett

[57] ABSTRACT

A process is disclosed for separating tobacco stems from tobacco leaves which comprises freezing the leaves, subjecting them to flexing to break the lamina free from the stems, and then separating the stems from the lamina. Generally, it is preferable to freeze the tobacco leaves, at a temperature between about 0°C. and −210°C., and to flex the frozen leaves as gently as possible to leave the stem unbroken.

14 Claims, 4 Drawing Figures

FIG. 1
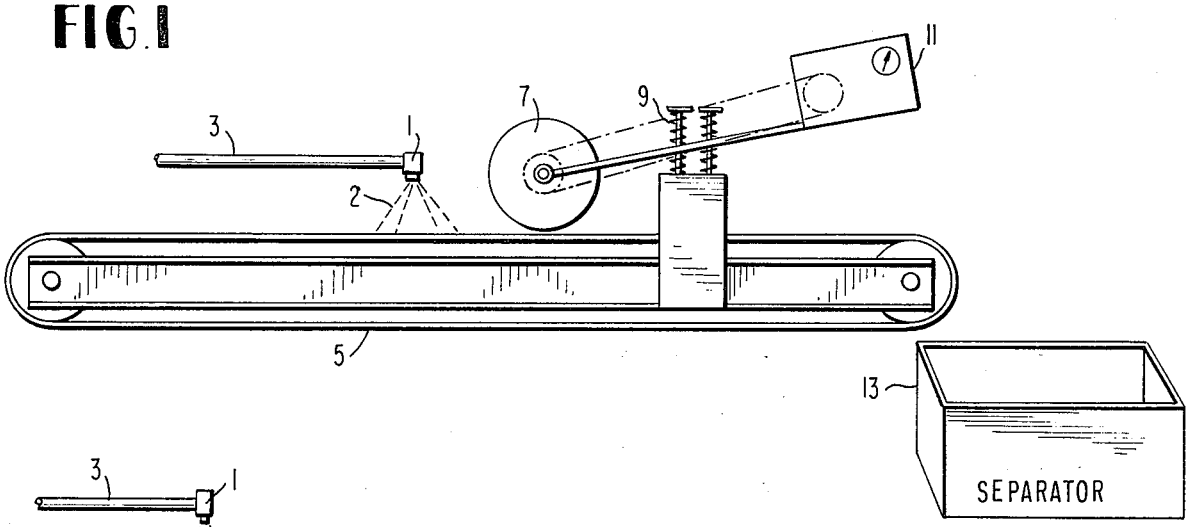
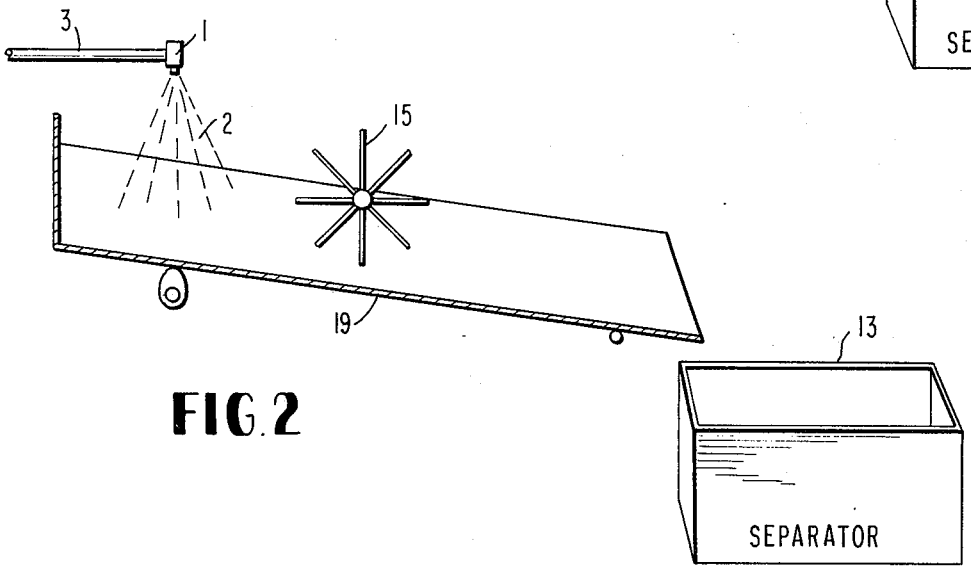
FIG. 2
FIG. 3
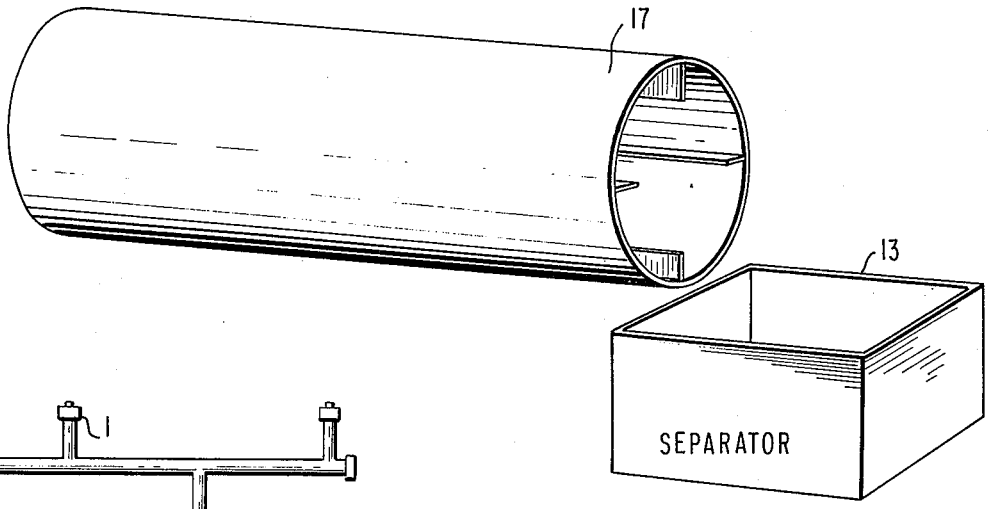
FIG. 4
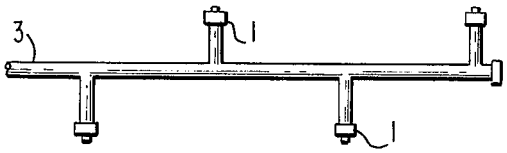

CRYOGENIC THRESHING OF TOBACCO

FIELD OF THE INVENTION

This invention relates to a process for removing tobacco stems from tobacco leaves. More specifically, the present invention pertains to a process in which tobacco leaves are cooled to very low temperatures and then flexed to separate the stems and lamina.

BACKGROUND OF THE INVENTION

Tobacco leaf stems have generally been found to be objectionable in smoking tobacco blends, particularly in blends for cigars and cigarettes. Stems have undesirable burning qualities and their stiffness may lead to deformed or punctured wrappers. In making smoking tobacco products, it is therefore customary to subject tobacco leaf to a threshing operation to separate the stem from the remainder of the leaf.

The stems, after separation, may be processed to produce products useful in smoking products. For example, they may be ground, mixed with fines, and converted into synthetic leaf, or the whole stem may be converted to useable filler material by an enzymatic process. Relatively long pieces of stem are more suitable for processing into a smoking product. In addition, relatively long pieces of stem are easier to remove from the rest of the leaves. Thus, any commercially suitable threshing process must result in the production of relatively long stems.

The remainder of the leaf, the lamina, is the portion that is the most important in production of smoking tobacco products. High grade tobacco products contain little stem and the lamina is by far the most valuable part of the leaf. Consequently, it is desirable to remove the stems with as little attached lamina as possible.

It is also commercially desirable to keep the lamina in relatively large pieces. Large pieces may be handled and shredded more easily during processing into high quality tobacco filler for cigars and cigarettes. Even more importantly, the destemming process must keep the production of fines, the dustlike particles of lamina, to a minimum. Tobacco fines, unless processed into reconstituted tobacco sheets, are not suitable for use in tobacco products. Thus, production of large amounts of fines represents a significant loss of valuable lamina.

In known tobacco leaf destemming processes, the leaf stems are separated from the leaf lamina by first subjecting the leaves to a mechanical threshing action of sufficient duration and intensity to completely detach the lamina from the stems. The resulting stem-lamina mixture is then subjected to a classification step. In typical threshers, lamina is separated from stems or veins by the action of one or more toothed rotors beating against stationary teeth, or by the action of counter-rotating toothed rotors, or by the action of a toothed rotor beating against a perforated cage or basket or by the action of a toothed rotor beating first against stationary teeth and then against a perforated cage or basket.

Because of the relatively ductile nature of the tobacco lamina, it will not easily break away from the stems. Therefore multiple impacts by the rotors are required to tear and rip the lamina and the stem must undergo violent flexing during this phase of the process, if all the lamina is to be removed from the stems and large veins.

The threshing processes currently in use, even if carefully controlled, result in the production of a preponderance of small pieces of lamina. In addition, an unacceptable amount of tobacco fines is produced, because of the pulverizing action of the toothed rotors and the multiple impacts required to completely detach all the lamina. The multiple impacts and violent flexing action also result in the production of broken and undesirably short stems.

In addition, current threshing processes often require, as an initial step, the addition of significant amounts of water, to permit handling of the leafs without causing undue fragmentation of the lamina. This water has to be removed in a drying step, subsequent to classification, before the tobacco lamina can be processed into a marketable product.

The present invention provides a technique whereby the stems can be easily detached from the tobacco leaves and then separated from the lamina. The technique of the present invention results in the production of relatively large pieces of lamina and long stems and veins. Furthermore, the process of the present invention does not require the addition of large amounts of water to prepare the tobacco for the stem separation process.

SUMMARY OF THE INVENTION

The process of the present invention comprises cooling tobacco leaves until they are frozen, subjecting the frozen leaves to flexing whereby the lamina are detached from the stem, and finally separating the detached lamina and stems for subsequent processing.

The leaves should be cooled to a temperature of between about 0°C. and −210°C., preferably between about −30°C and about −60°C. While the moisture content of the leaves is not critical, it is preferably maintained between about 15% and 25% by weight.

BRIEF DESCRIPTION OF THE DRAWINGS

FIG. 1 is a schematic illustration of one embodiment of the present invention, in which a spray of cold liquid is employed for freezing the tobacco leaves and an adjustable compression roller acting on a moving conveyor provides means for flexing the frozen leaves.

FIG. 2 is a schematic illustration of another embodiment of the present invention, also employing a spray of cold liquid, but using a mechanical doffer and a vibrating conveyor to provide means for flexing the leaves.

FIG. 3 is a schematic illustration of yet another embodiment of the present invention, in which a spray of cold liquid is used and a tumbler is employed to achieve flexing.

FIG. 4 illustrates a multiple nozzle arrangement which may be employed in the embodiment of FIG. 3.

DESCRIPTION OF THE PREFERRED EMBODIMENTS

In the process of the present invention, the cooling can be accomplished by any suitable means, such as by placing the tobacco leaves inside a suitable enclosure provided with a refrigerator system. Preferably, however, the leaves are cooled directly by contact with a cold liquid, such as liquid nitrogen or a dry ice-ethyl alcohol slurry. Contact with the cold liquid can be accomplished by totally or partially immersing the leaves, or the liquid can be sprayed or splashed on the leaves.

Regardless of the cooling technique employed, it is essential that the leaf be cooled to at least 0°C., and preferably at least −30°C. At higher temperatures, good separation is not achieved and unacceptable levels of fines are generated.

Upon cooling tobacco leaves, stem freezes before lamina. Preferably, to obtain good stem separation, both the lamina and stem are frozen prior to flexing. However, the tobacco leaves can be removed from the cooling stage and subjected to the flexing process with only the stems, and the portion of the lamina immediately adjacent to the stems frozen.

The method of providing the flexing action is not critical. Any means which will mechanically flex or vibrate the leaves is suitable. For example, the flexing can be accomplished by rolling the leaves with adjustable compression rollers. Alternatively, the frozen leaves can be placed in a tumbler. The tumbler preferably contains tumbling elements to impart further flexing, in addition to that provided by the weight of the leaf charge itself. In other embodiments, the flexing can be imparted by direct impact with toothed rotors or other rotating or reciprocating mechanical threshing means.

Flexing also can be accomplished with hydraulic impinging jets employing liquid, gas or two-phase (gas-liquid, gas-solid, or liquid-solid) working fluids, such as sand blasts or water jets. In addition, the lamina can be detached by vibrating the frozen leaves, as by a vibrating conveyor system or shaker. The leaves can be submerged in a coolant during vibration. Combinations of these flexing means, of course, can be employed.

The best results, in terms of large size pieces of lamina and minimum fine production, occur when the controllable parameters of the selected flexing means are chosen to provide a relatively gentle flexing action. The separation of the detached lamina and stems can be carried out by known techniques, such as forced air classification.

In the embodiment shown schematically in FIG. 1, the tobacco leaves are fed onto a moving conveyor 5 and pass under a spray of liquid nitrogen 2. The liquid nitrogen issues from spray head 1, fed from coolant distribution means 3. Conveyor 5 subsequently carries the frozen leaves under compression roller 7. Roller 7 acts upon the frozen leaves to detach the lamina from the stem. From this point the detached, but intermingled, pieces of lamina and stems are fed into separation means 13 to segregate these components. The coolant flow rate, conveyor speed, and leaf feed rate are preferably controlled to produce leaf temperatures of from −30°C. to −60°C. at the position where the compression roller 7 engages the leaves.

The compression roller 7 may have a partially yielding surface, such as a rubber coating on a steel roller. Such a surface tends to avoid pulverizing the stem by conforming to the stem while exerting sufficient force on the immediately adjacent lamina to cause it to detach from the stem at the lamina stem interface. The downward force of the roller is provided by the sum of its own weight plus adjustable spring force means 9. The compression roller 7 is driven by a roller drive means 11 arranged as a counter weight to partially off-set the downward force.

Adjustable spring force means 9 can be regulated to obtain different roller pressure on the leaf. Obviously the pressure is selected to provide optimum operation, in terms of lamina-stem separation and lamina piece size.

In the embodiment shown schematically in FIG. 2, the tobacco leaves are fed onto a vibrating conveyor 19. The leaves pass under a spray of liquid nitrogen 2 issuing from spray head 1 which is supplied by coolant distribution means 3. The frozen leaves are then carried under a mechanical thresher means, such as rotating doffer 15 where the lamina is detached from the stems. The intermingled stems and pieces of lamina are subsequently carried into the separator means 13.

In addition to providing threshing means, doffer 15 serves to keep the tobacco in the liquid nitrogen spray 2 until the desired leaf temperature is reached.

Doffer 15 can be replaced with other threshing means, such as a wire reinforced rubber pipe in contact with the vibrating conveyor or multiple doffers. Multiple doffers rotating at different speeds may be employed.

In the embodiment depicted in FIGS. 3 and 4, the tobacco leaves are fed into a tumbler 17. Liquid nitrogen is sprayed on the leaves from multiple spray heads 1, fed from a coolant distribution means 3. The multiple spray heads 1 are inserted into the tumbler 17 approximately parallel to the rotational axis. After the leaves have become frozen, flexing caused by the tumbling causes the lamina to detach from the stem. Subsequently, the mixture of pieces of lamina and stems are fed into the separation means 13.

As in the embodiments of FIGS. 1 and 2, the liquid nitrogen spray rate and batch spray time are selected to produce the desired leaf temperature prior to flexing. The rotation rate of tumbler 17 is chosen to provide optimum separation, depending on the nature and amount of tobacco employed and the actual temperature used.

It will be apparent to those skilled in the art that various modifications and variations could be made in the process constituting this invention without departing from the spirit and scope of the invention.

What is claimed is:

1. A process of removing tobacco stem and vein structures from tobacco leaves comprising:

a. cooling said leaves to a temperature of between 0°C and about −210°C whereby said tobacco leaves are frozen;

b. flexing said frozen leaves whereby tobacco lamina is broken free from said stem and vein structures; and c. separating said stem and vein structures from said lamina.

2. The process of claim 1 wherein the initial moisture content of said leaves is about 15% to about 25% by weight.

3. The process of claim 1 wherein said leaves are cooled by contact with liquid nitrogen.

4. The process of claim 1 wherein said leaves are cooled by contact with a dry ice/alcohol slurry.

5. The process of claim 3 wherein said liquid nitrogen is sprayed on said leaves.

6. The process of claim 1 wherein said leaves are cooled to a temperature of about −30°C. to about −60°C.

7. The process of claim 1 wherein said frozen leaves are flexed with a compression roller.

8. The process of claim 1 wherein said frozen leaves are flexed with a rotating doffer.

9. The process of claim 1 wherein said frozen leaves are flexed by tumbling.

10. The process of claim 1 wherein said frozen leaves are flexed by vibrating.

11. The process of claim 1 wherein said frozen leaves are subjected to a fluid jet.

12. The process of claim 1 wherein said separating is by air classification.

13. The process of claim 1 wherein the separating step includes the step of removing unpulverized portions of lamina.

14. The process of claim 1 wherein the separating step includes the step of preserving the stem and vein structures substantially intact.

* * * * *